United States Patent [19]

Francis

[11] 3,940,853

[45] Feb. 3, 1976

[54] SHAVING UNIT WITH BLADE TENSIONING MEANS

[75] Inventor: John F. Francis, Woking, England

[73] Assignee: The Gillette Company, Boston, Mass.

[22] Filed: Oct. 11, 1974

[21] Appl. No.: 514,025

[30] Foreign Application Priority Data

Apr. 19, 1974 United Kingdom ..... 17363/74

[52] U.S. Cl. ..... 30/346.58; 30/52

[51] Int. Cl.[2] ..... B26B 21/22

[58] Field of Search ..... 30/50, 52, 339, 346.57, 30/346.58, 346.59

[56] References Cited

UNITED STATES PATENTS

| | | | |
|---|---|---|---|
| 783,660 | 2/1905 | Williams | 30/52 X |
| 1,975,757 | 10/1934 | Gray | 30/52 X |
| 3,013,553 | 12/1961 | Auerback | 30/339 X |
| 3,660,893 | 5/1972 | Welsh | 30/52 X |

*Primary Examiner*—Al Lawrence Smith
*Assistant Examiner*—Gary L. Smith

[57] ABSTRACT

A razor blade unit in the form of an elongated blade member, at least one long edge of which is constituted by a cutting edge, and means engaged with the blade member and in compression to strain the ends of the blade member apart.

18 Claims, 12 Drawing Figures

FIG 7
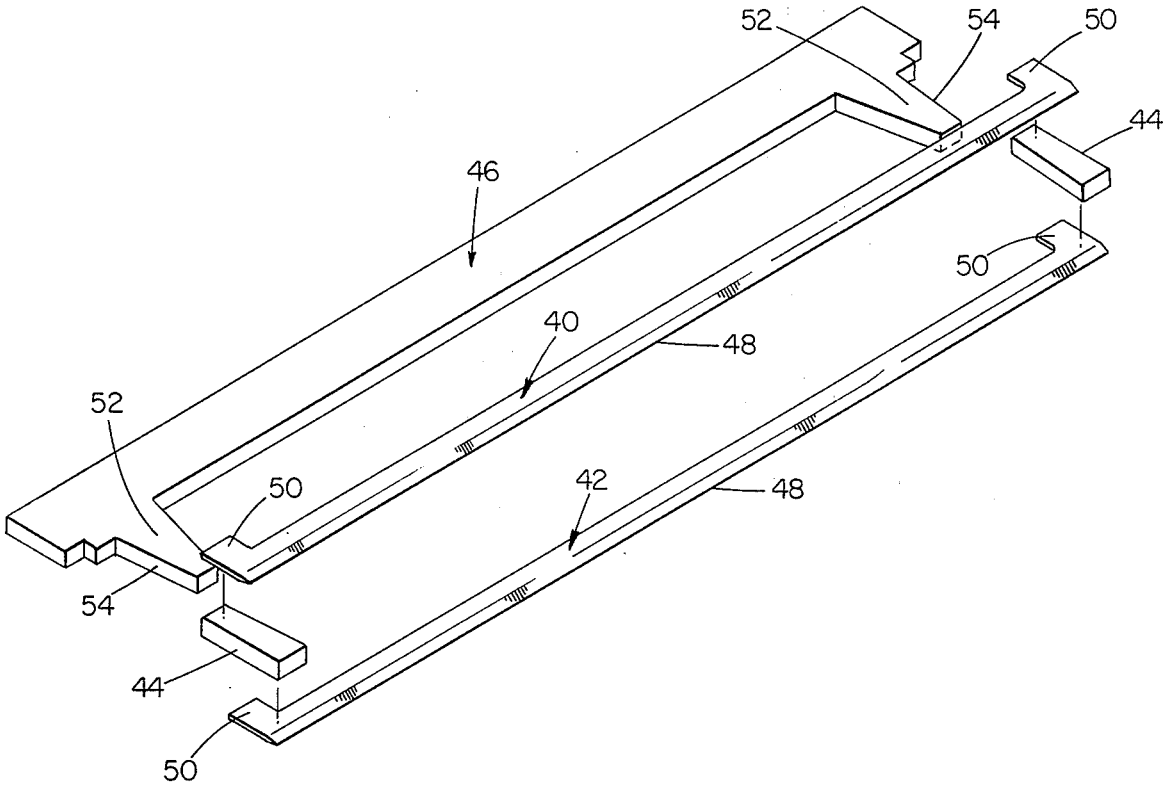
FIG 8
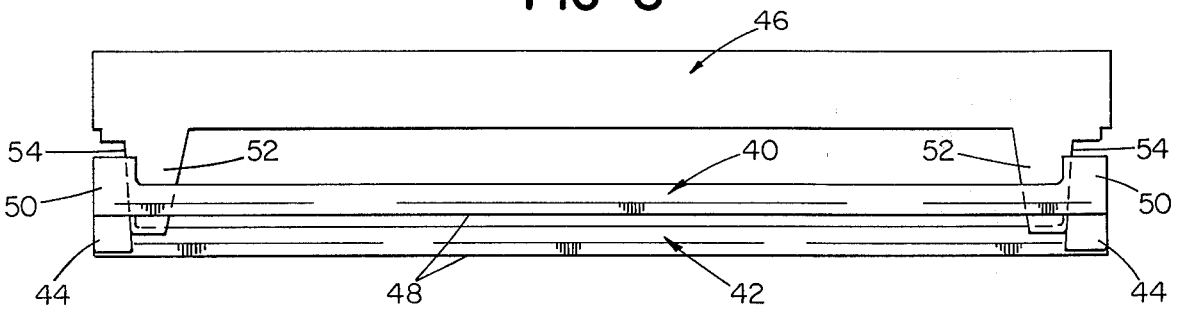
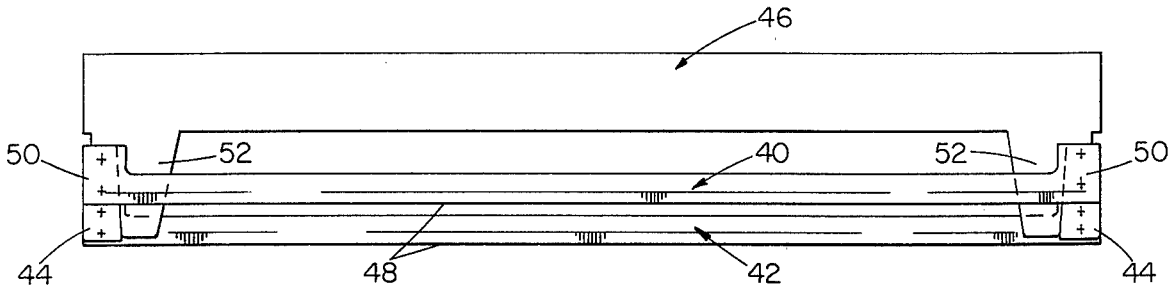
FIG 9

SHAVING UNIT WITH BLADE TENSIONING MEANS

SUMMARY OF INVENTION

The prior U.S. Pat. No. 3,660,893 describes a safety razor having a blade which is secured in the razor at its ends only, the intermediate portion of the blade, on which the cutting edge is formed, being left unclamped and held under tension directed longitudinally of the blade, parallel to the cutting edge.

The present invention is concerned with razors of this form, and is primarily directed to providing improved means of producing and maintaining the requisite blade tension.

In accordance with the present invention there is provided a razor blade unit in the form of an elongated blade member, at least one long edge of which is constituted by a cutting edge, and means compressively engaged with the blade member to strain the ends of the blade member apart.

In the particular embodiments described below, the unit comprises two blade members rigidly secured together in spaced, parallel relationship with spacers located between adjacent ends of the two blade members, and both blade members are tensioned by means of a single wedge member that is located in the space between the ends of the blade members and that has cooperating wedging engagement with at least one of the spacers.

In one embodiment, the (or each) blade member is itself of open rectangular form.

In a second embodiment, a rectangular frame is defined by a pair of elongated, strip like blade members permanently secured together by means of spacers between the blade members at opposite ends thereof. Thus, in this case, the two blade members constitute the long sides of a rectangular frame and the spacers the short sides of that frame.

With these arrangements, it becomes a practical proposition to mass-produce a shaving unit in the form of a cartridge including guard and cap members with the blade units permanently sandwiched in between and held in a tensioned condition, the cartridge being removed as a unit and discarded when the cutting edges become dulled. The invention therefore includes within its scope a shaving unit of this "disposable" cartridge type.

Two presently preferred forms of blade units and shaving units incorporating the same will now be described, by way of example, with reference to the accompanying drawings, in which:

FIG. 7 is a perspective exploded view of a second form of blade unit;

FIG. 8 is a plan view of the blade unit of FIG. 7 immediately prior to final assembly;

FIG. 9 is a plan view of the blade unit of FIG. 7 after final assembly;

DESCRIPTION OF PARTICULAR EMBODIMENTS

Figure 1:
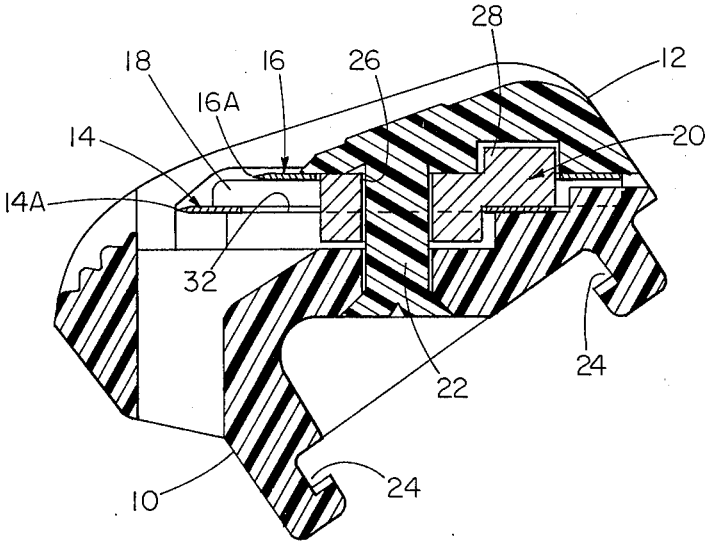
FIG. 1 is a cross-section of a disposable shaving unit in accordance with the invention.

The disposable cartridge shaving unit of FIG. 1 comprises: a platform and guard member 10; a cap member 12 permanently secured to the member 10; and a blade assembly sandwiched between the members 10 and 12 and comprising primary and secondary blades 14 and 16, a pair of spacers 18 and a wedge member 20.

The member 10 and cap 12 are both formed as synthetic plastic mouldings, the parts being secured by integral pins 22 on the cap 12 passing downwardly through the member 10 and being upset by pressure (and optionally heat) to "rivet" the parts together. The member 10 has in its underside an undercut slot 24 for engagement with support rails formed on a razor handle (not shown) which is of known form in itself.

Figure 2:
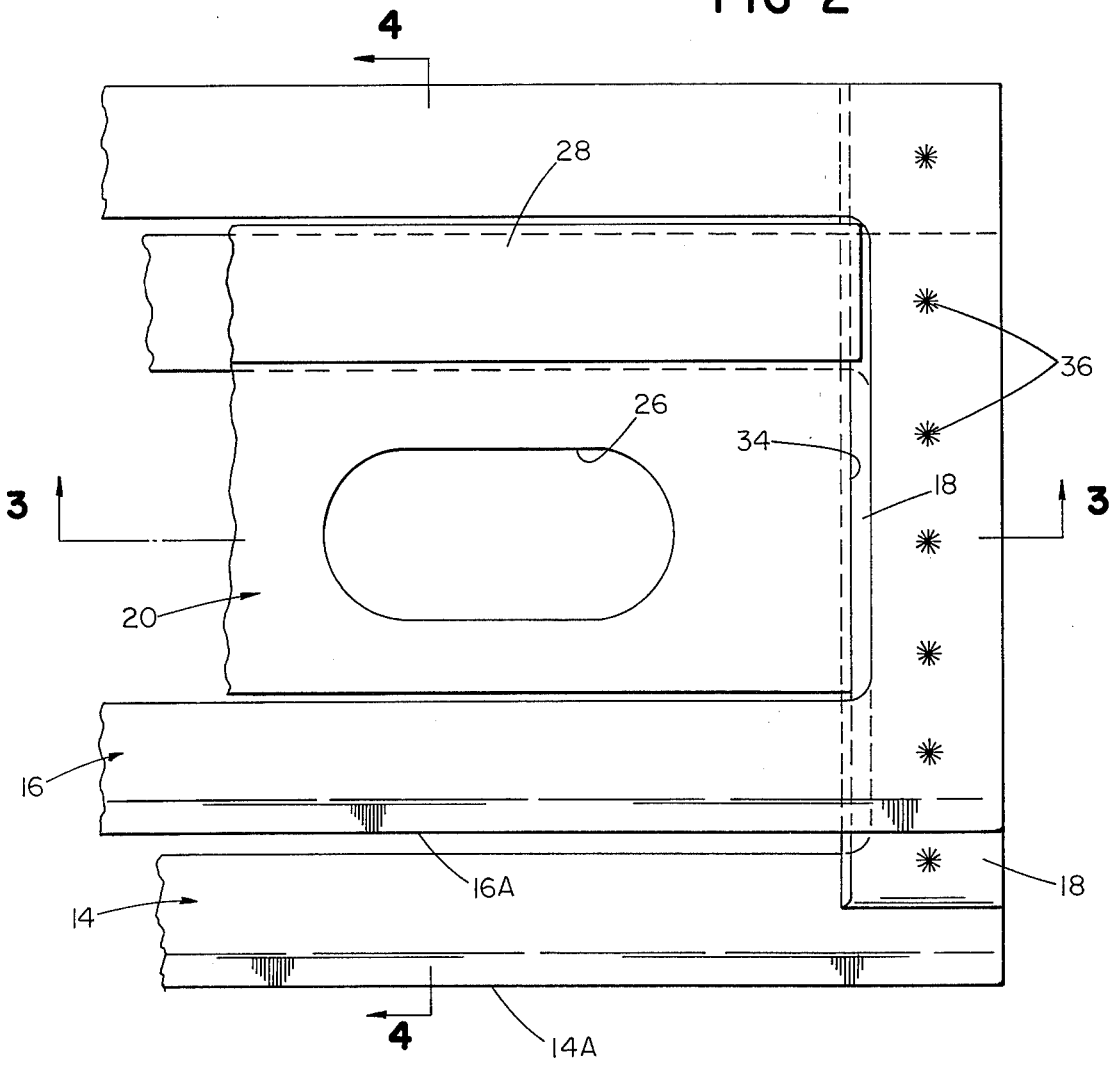
FIG. 2 is a plan view of a portion of a blade unit in accordance with the invention and forming part of the unit of FIG. 1, drawn to a larger scale.
Figure 3:
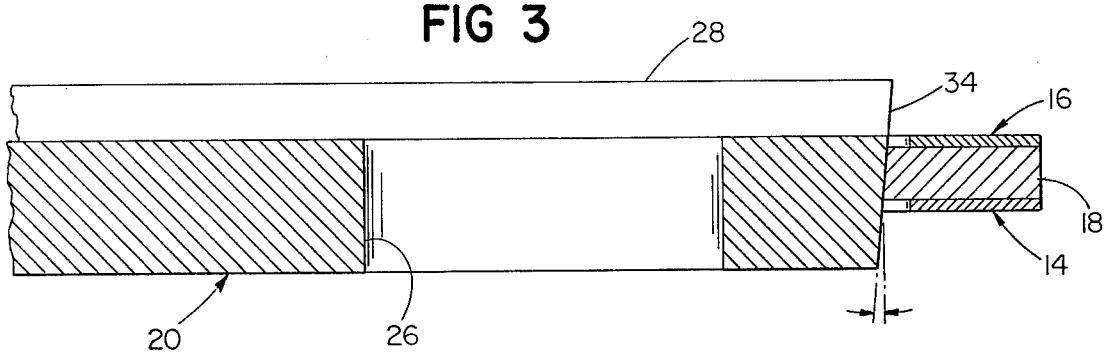
FIG. 3 is a sectional view along the line 3—3 of FIG. 2.
Figure 4:
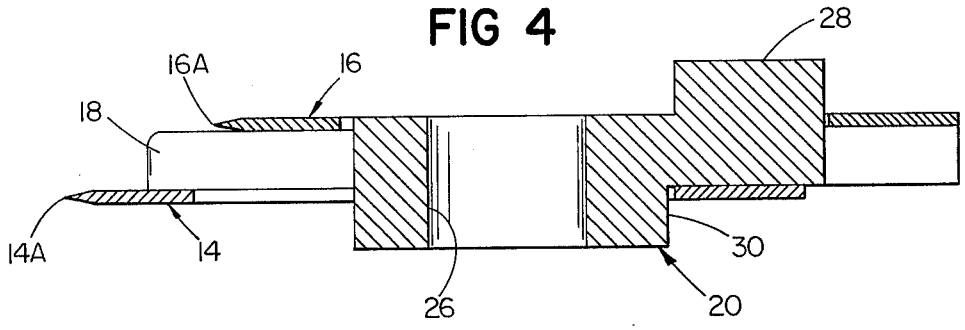
FIG. 4 is a sectional view along the line 4—4 of FIG. 2.

The blade unit is best seen in FIGS. 2 to 4, of which FIGS. 2 and 3 show only one end portion of the assembly.

Each of the blades 14 and 16 is in the form of an elongated, rectangular open frame, the outer edge of one long side of which is sharpened to a cutting edge 14A, 16A. The blades are held in spaced parallel relationship by a pair of spacers 18, each secured to and positioned between the adjacent superposed edges of the blades at one end of the assembly. The blades are conveniently of identical form, being offset in the assembly in a direction at right angles to the edges 14A, 16A to suit the required shaving geometry.

The wedge member 20 is a machined or pressed metallic member (for example, of brass) provided with clearance holes 26 for the pins 22. The member is of generally rectangular form as viewed in plan and in end elevation has a continuous ridge 28 along its rear edge which is disposed with clearance in a slot in the underside of the cap member 12, and is relieved at 30 on its underside to clear the rear side of primary blade 14 and the shoulders 32 on the platform member 10 (see FIG. 1) on which the primary blade 14 rests.

As seen in FIG. 3, end face 34 of the wedge member 20 mates with and abuts the adjacent face of a spacer 18, these faces being sloped at an angle of 5° to the vertical. The corresponding faces of the wedge and spacer at the opposite end of the unit are similarly angled and abutting, so that the wedge member has an included taper of 10°. In the fully assembled condition illustrated, the wedge member is compressively engaged between the spacers 18 and the longitudinal sides of the blades are correspondingly tensioned.

Figure 5:
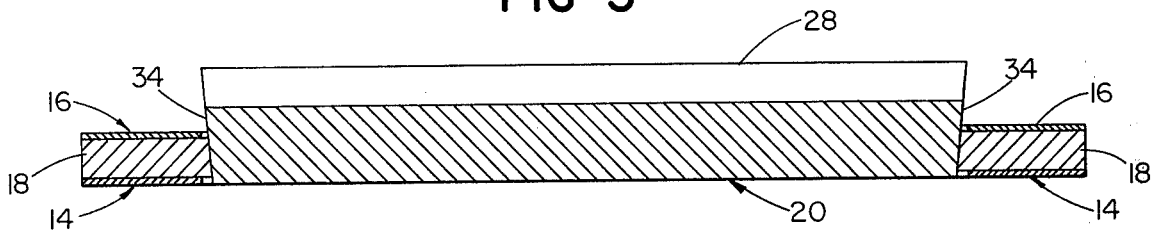
FIGS. 5 and 6 illustrate, somewhat diagrammatically, the manner of producing the blade unit of FIGS. 2 to 4.
Figure 6:
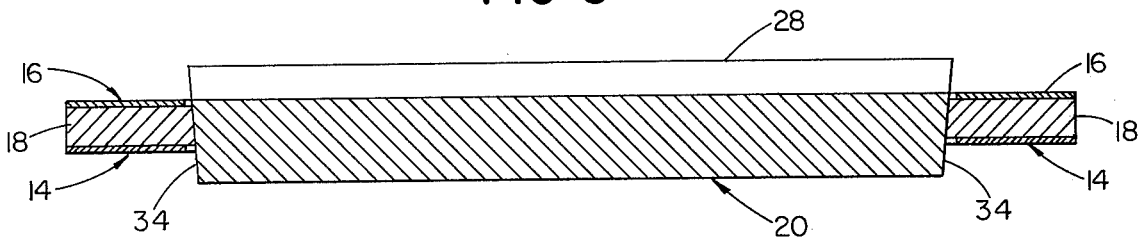

FIGS. 5 and 6 serve to illustrate a method of forming the blade assembly.

In the first stage, illustrated in FIG. 5, two blades are superposed with the spacers 18 loosely inserted. The wedge member 20 is then dropped into position, so that its lower surface is flush with the lower surfaces of the primary blade 16 and with its sloping end faces 34 diverging upwardly. The spacers 18 are then pressed inwardly, to bear firmly against the faces 34, thereby taking up clearances, and the blades and spacers are permanently secured together, for example by spot welding as indicated at 36.

Finally, as shown in FIG. 6, the wedge member is forced through the blade and spacer assembly by a controlled amount, i.e. in a direction perpendicular to the planes of the blades, so that the wedge faces 34 force the spacers 18 apart and thereby tension the long edges of the blades. The wedge member is, of course, correspondingly compressed and is held compressively engaged without any further fixing being necessary, the use of shallow wedging angles providing a good degree of security to the assembly. Of course, additional fixing or locking means could be provided if found necessary or desirable in any particular unit.

The above-described assembly technique will, of course, be accomplished in practice with the aid of assembly jigs and is highly suitable for high-speed, automated production. Once the blade assembly is completed it is easily handled as a unit, and final assembly effectively entails the handling of only three components, the members 10 and 12 and the blade assembly, and the shaving unit is completed by known production techniques for disposable cartridge units.

It will be readily appreciated that the construction and assembly of the blade unit are particularly well adapted for mass-production, for two main reasons. First, the use of separate spacers 18 which can be manipulated to take up clearances before the final wedging is effected tends to minimize the requirement for close tolerances in the individual components of the assembly. Secondly, good control of the degree of blade tensioning is possible in a simple manner. The tension is, of course, a function of taper angle and displacement of the wedge member between its initial position (FIG. 5) and its final position (FIG. 6) and this in turn is controlled (preferably) by the thickness of the member 20.

In a specific example, stainless steel blades 14, 16 are each 0.004 inch thick, 1.5 inch long and 0.28 inch wide, with the long sides of the blades having a width of 0.05 inch. The included taper angle is 10° and the wedge member is driven in through a distance of 0.022 inch, to produce an extension of length of the blades of about 0.004 inch. The resultant tension of the blades (which has been measured at some 6 to 14 pounds in each blade) has been found highly satisfactory, but it will be appreciated that the tensile force required will vary widely between blades of different configuration and dimensions. For example, the tension typically required to give a satisfactory shaving performance will decrease if the blade is thicker, wider, or shorter, since it will have increased resistance to tension and lateral flexure in longitudinal planes perpendicular to its own plane.

One feature of the unit particularly advantageous to the user is that the unit exhibits very little tendency to trap shaving soap and debris between the blades 14 and 16, due to the full length open slot left between the rear or inner edge of the front side of the lower blade and the forward face of member 20, as seen in FIG. 1.

The unit and method described and illustrated herein will, of course, be subject to many modifications within the scope of the present invention. For example, the invention is applicable to double edged blades, i.e., in which both outer edges of the long sides of the frame are sharpened, as in a reversible head razor or a double-sided razor. Alternatively, the shaving unit may only have a single blade in which case the ends of the blade will probably have blocks secured to them to perform the function of the above-described spacers 18. Such a single blade may again be single edged or double edged. The blade assembly may in some units be adjustable, relative to the guard, to permit adjustment of blade exposure. The required wedging action could, of course, be achieved by different means. For example, the total wedging taper may be formed in one end face only, the other being square, or a two-part wedge assembly could replace the single wedge member described.

A second form of blade unit in accordance with the invention is shown in FIGS. 7 to 9 and comprises a pair of blade members 40, 42, a pair of spacers 44 between the blades at opposite ends thereof and a wedge member 46.

The blade members 40 and 42 are of identical form; each being a narrow elongated strip, say 0.004 inch thick (1.0 mm.), having its leading edge sharpened to a cutting edge 48 and having at its ends a pair of rearwardly extending arms 50.

The spacers 44 are, like the blades, of steel, and each takes the form of a simple rectangular block.

The wedge member 46 comprises a metal plate having two forwardly projecting portions in the form of horns 52, whose thickness is substantially equal to, but no greater than, the thickness of the spacer (about 0.02 inch (0.5 mm. in a particular embodiment) and whose outer faces 54 are each inclined at an angle of some 4° (an included angle of 8°) to a line at right angles to the blade edges and in the plane of the blades.

In manufacture, the blades 40, 42 and spacers 44 are superposed in their approximate final positions and the horns 52 of the wedge member 46 are partially inserted between the blades and the spacers. The spacers are then pushed in against the sloping outer faces 54 of the horns and the blades and spacers are secured together as by spot welding (in position as indicated in FIG. 8). At this stage, the blades are untensioned, but assembly is completed by pushing the wedge member fully home (to the position indicated in FIG. 9) so as to strain the spacers apart by virtue of the wedging action of the horns, thereby tensioning the blades. The frictional restraint between the horns and the spacers is sufficient, to maintain the assembled condition, without any further fixing of the wedge member relative to the other parts.

The blade unit has a number of practical advantages and virtues. It is very economical in the use of blade material, since the maximum width of the blade members (i.e., at the ends) in the embodiment described is only 0.08 inch (2 mm.). Also, the area between the blades is completely open, except for the horns 52, which is of great assistance in the clearing of shaving debris.

Because of its compact and rigid construction, the blade unit is inherently adapted to be matched to a wide range of razor designs. It could for example be employed as a replacement unit in an injector razor system, or incorporated in a disposable shaving unit system.

Figure 10:
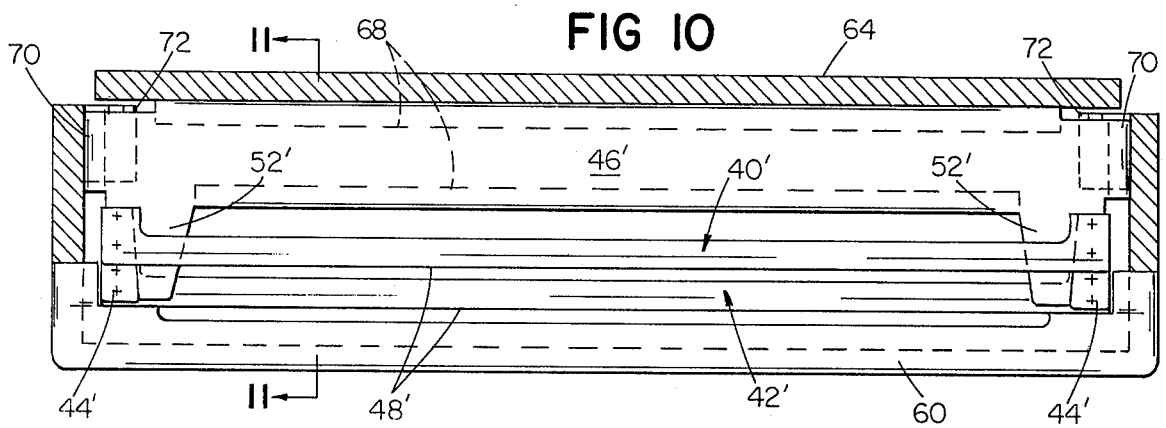
FIG. 10 is a plan view (with the cap portion broken away) of a shaving unit incorporating a blade unit similar to the type shown in FIG. 9.
Figure 11:
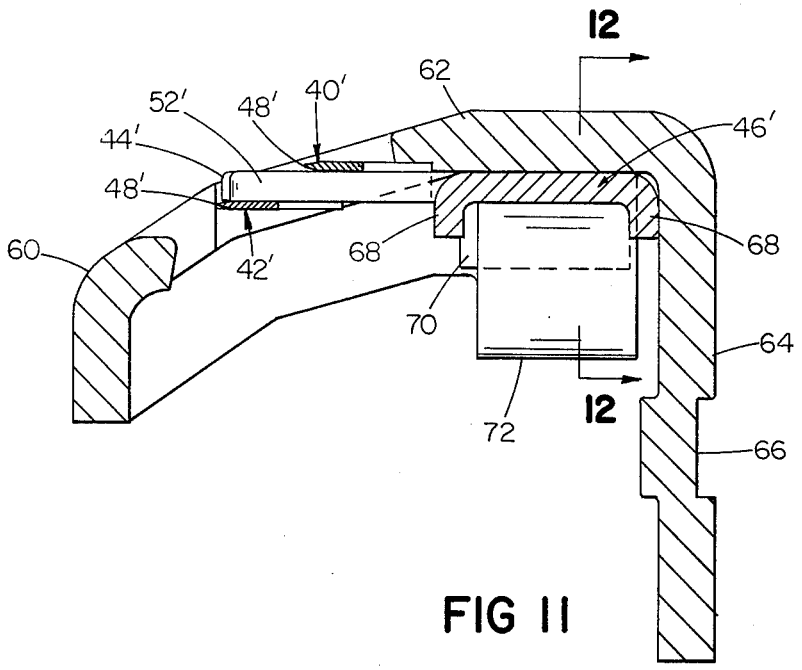
FIG. 11 is a sectional view of the shaving unit along the line 11—11 of FIG. 10.
Figure 12:
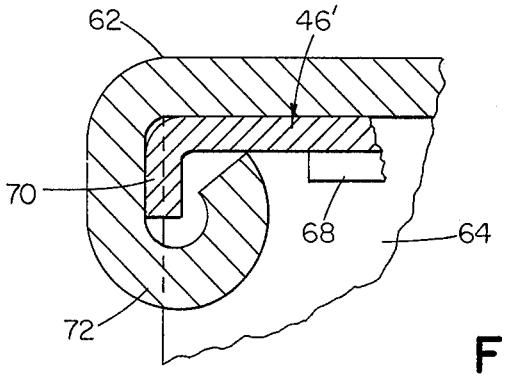
FIG. 12 is a sectional view of a portion of the shaving unit along the line 12—12 of FIG. 11.

An example of this latter type is illustrated in FIGS. 10–12. The shaving unit in which a blade unit similar to the above described blade unit is mounted includes an integral pressing constituting a guard 60, a cap 62 and a neck 64 which is joggled (as at 66) or otherwise adapted for releasable engagement with a razor handle. In this embodiment, the forward and rear edges of the wedge member 46 are turned down to form flanges 68 between the horns 52 to stiffen the blade longitudinally. At its ends, to the rear of the blades, the member 46 is turned down to provide end flanges 70 (see also FIG. 12). The blade unit is secured to the pressing by turning end portions 72 of the pressing inwardly over the flanges 70, thereby forming a secure, permanent assembly.

While particular embodiments of the invention have been shown and described, various modifications will be apparent to those skilled in the art and therefore it is not intended that the invention be limited to the disclosed embodiments or to details thereof, and departures may be made therefrom within the spirit and scope of the invention.

What is claimed is:

1. A razor blade unit comprising two elongated blade members, at least one long edge of each being constituted by a cutting edge, spacer members securing said blade members together at the opposite ends thereof, and a wedge having opposed end faces in engagement with the adjacent inner faces of said spacer members and extending in a direction perpendicular to the planes of said blade members, said wedge being in compression to strain the ends of said blade members apart and maintain both of said blade members in tension.

2. A razor blade unit comprising two elongated blade members, at least one long edge of each being constituted by a cutting edge, spacer members securing said blade members together at the opposite ends thereof, and a wedge having opposed end faces in engagement with the adjacent inner faces of said spacer members and extending between said blade members in a direction parallel with the planes of the blade members, said wedge being in compression to strain the ends of said blade members apart and maintain both of said blade members in tension.

3. A blade unit as claimed in claim 2 wherein said wedge has a pair of forwardly projecting portions, the said portions engaging at their outer faces, the respective inner faces of said spacer members.

4. A blade unit as claimed in claim 3 wherein said blade members are identically formed and are offset laterally with respect to each other.

5. A razor blade unit in the form of an open rectangular frame that includes an elongated blade portion and two spacer portions, one at each end of said blade portion, and thickness of each said space portion being greater than the thickness of said blade portion, at least one long edge of said blade portion being constituted by a cutting edge, the opposite ends of said blade portion being connected to said spacer portions and said blade portion being unsupported intermediate its opposite ends so that the intermediate area between said opposite ends is open and assists in the clearing of shaving debris, and wedge means fixed in compressive engagement within said open rectangular frame in engagement with said spacer portions to tension said cutting edge.

6. A blade unit as claimed in claim 5 wherein said blade unit further includes a second elongated blade member, at least one long edge of which is constituted by a cutting edge, said blade members being rigidly secured together in spaced, parallel relationship with said spacer portions located between adjacent ends of the two blade members, and wherein both blade members are tensioned by means of said wedge means, said wedge means being in the form of a single wedge member located in the space between the ends of the blade members and having cooperating wedging engagement with at least one of said spacer portions.

7. A blade unit as claimed in claim 6 wherein the each said blade member is itself of open rectangular form.

8. A blade unit as claimed in claim 5 wherein said wedge means is a wedge member having at least one end face having cooperating wedging engagement with an adjacent surface portion integral with said blade member, the said one end face being inclined to the plane of the opposite end face of said wedge member.

9. A blade unit as claimed in claim 5 wherein said blade unit includes first and second elongated blade members, said blade members being offset laterally with respect to each other and being unsupported intermediate their opposite ends so that the intermediate area between said opposite ends is completely open and assists in the clearing of shaving debris, said wedge means maintaining both of said blade members in tension.

10. A shaving unit including cap and guard structure and a blade unit permanently secured between said cap and guard structure, said blade unit being in the form of an open rectangular frame and including first and second elongated blade members, one long edge of each said blade member being constituted by a cutting edge, said blade members being laterally offset with respect to each other and being connected to end portions of the frame at their opposite ends and being unsupported intermediate their opposite ends so that the intermediate area between said opposite ends is completely open and assists in the clearing of shaving debris, and wedge means fixed in compressive engagement within said open rectangular frame and engaging said end portions of said frame to strain the ends of said frame apart and maintain both of said cutting edges in tension.

11. A shaving unit as claimed in claim 10 wherein said cap and guard structure is an integral pressing and said blade unit is secured to said pressing by deformation of portions of said pressing.

12. A shaving unit as claimed in claim 10 wherein said cap and guard structure includes a cap member and a separate platform member, said platform member having a guard portion attached thereto and said blade unit is clamped in sandwich relation between said cap member and said platform member.

13. A shaving unit as claimed in claim 10 wherein said end portions are spacer members and said wedge means is a single wedge member located in the space between the ends of said blade members secured solely by co-operating wedging engagement with at least one of said spacer members.

14. A shaving unit as claimed in claim 13 wherein the (or each) blade member is itself of open rectangular form.

15. A shaving unit including cap and guard structure and a blade unit permanently secured between said cap and guard structure, said blade unit comprising two elongated blade members, at least one long edge of each being constituted by a cutting edge, spacer members securing said blade members together at the opposite ends thereof, and a wedge having opposed end faces in engagement with the adjacent inner faces of said spacer members and extending in a direction perpendicular to the planes of said blade members, said wedge being in compression to strain the ends of said blade members apart and maintain both of said blade members in tension.

16. A shaving unit including cap and guard structure and a blade unit permanently secured between said cap and guard structure, said blade unit comprising two elongated blade members, at least one long edge of each being constituted by a cutting edge, spacer members securing said blade members together at the opposite ends thereof, and a wedge having opposed end faces in engagement with the adjacent inner faces of said spacer members and extending between said blade members in a direction parallel with the planes of the blade members, said wedge being in compression to strain the ends of said blade members apart and maintain both of said blade members in tension.

17. A shaving unit as claimed in claim 16 wherein said wedge has a pair of forwardly projecting portions, the said portions engaging at their outer faces, the respective inner faces of said spacer members.

18. A shaving unit as claimed in claim 17 wherein said blade members are identical.

* * * * *

UNITED STATES PATENT AND TRADEMARK OFFICE

CERTIFICATE OF CORRECTION

PATENT NO. : 3,940,853
DATED : March 2, 1976
INVENTOR(S) : John F. Francis

It is certified that error appears in the above-identified patent and that said Letters Patent are hereby corrected as shown below:

The patent date (item [45]) should be changed from "February 3, 1976" to --March 2, 1976--.

Under "References Cited" (item [56]), "Auerback" should be --Averback--.

Column 5, line 49, change "and" to --the--.

Column 6, line 6, delete "the".

Signed and Sealed this
*first* Day of *June 1976*

[SEAL]

*Attest:*

RUTH C. MASON
*Attesting Officer*

C. MARSHALL DANN
*Commissioner of Patents and Trademarks*